United States Patent [19]

Miyashiro

[11] 4,291,686

[45] Sep. 29, 1981

[54] BACK AND SPINE EXERCISER

[76] Inventor: David J. Miyashiro, 733 Mililani St., Hilo, Hi. 96720

[21] Appl. No.: 111,697

[22] Filed: Jan. 14, 1980

[51] Int. Cl.[3] ..... A61H 7/00

[52] U.S. Cl. ..... 128/52

[58] Field of Search ..... 128/51, 52, 75

[56] References Cited

U.S. PATENT DOCUMENTS 3,168,094 2/1965 Siltamaki ..... 128/75

3,710,787 1/1973 Rabjohn ..... 128/75

3,786,803 1/1974 Petulla et al. ..... 128/75

3,835,847 9/1974 Smith ..... 128/75

*Primary Examiner*—John D. Yasko

*Attorney, Agent, or Firm*—Boris Haskell

[57] ABSTRACT

A back and spine exerciser provides a slow and small amplitude cyclical action of tension and relaxation of the tension to the back and spine of a user, by applying a corresponding pull and release under the chin of the user.

6 Claims, 3 Drawing Figures

BACK AND SPINE EXERCISER

BACKGROUND AND SUMMARY OF INVENTION

The present invention relates to a back and spine exerciser, particularly adapted for non-institutional, home use by individuals. The present exerciser functions to treat the back and spine by applying a gentle, relatively slow and small amplitude cyclic motion to the back and spine of the user by exerting a slight pull along the length of the spine followed by relaxation of the pull, in a uniform and repetitive fashion.

Numerous back traction devices are well known in the prior art, intended to relieve spinal pressures and backaches by placing the user and his spine under substantial traction force for substantial periods of time. Other body treatment devices are also well known, that subject portions of the body of the user to vibratory action, the purpose of which is to stimulate the muscles and tissues, frequently for the ultimate intended purpose of weight loss and muscle tone.

The concept of the present invention is quite different from these prior art devices. The purpose and function of the present invention is not to apply substantial traction forces to the user's back and spine, or to relieve spinal pressures by traction. Nor does the present invention apply vibratory stimulation to the body of the user. The present invention exerts a relatively slow, cyclic and gentle tension and relaxation of the tension to the spine of the user. The nature of the action imparted by the present invention will be appreciated from the fact that in a preferred embodiment, the cyclic stroke is only $\frac{7}{8}$ inch in length, and the cyclic period is only 6 cycles per minute. These particular values can be varied somewhat, of course, but to obtain the exercising, non-traction, non-vibratory effect of the invention, it is suggested that the stroke be between about $\frac{3}{4}$ and 1 inch, and not more than about 1 inch, and that the cyclic period be only a few strokes per minute, such as between about 5 and 7 strokes per minute.

It is therefore one object of the present invention to provide for the exercise of the back and spine, by applying thereto a slow cyclic and gentle action of tension followed by relaxation.

Another object of the present invention is to provide an apparatus for applying said cyclic action to the back and spine of a user.

The foregoing and other objects and advantages of the present invention will be fully appreciated from a consideration of the following detailed description of one illustrative specific embodiment of the invention.

BRIEF DESCRIPTION OF DRAWINGS

The following detailed description of the invention is had in conjunction with the accompanying drawings, in which like reference characters refer to like or corresponding parts, and wherein.

Detailed Description

Figure 1:
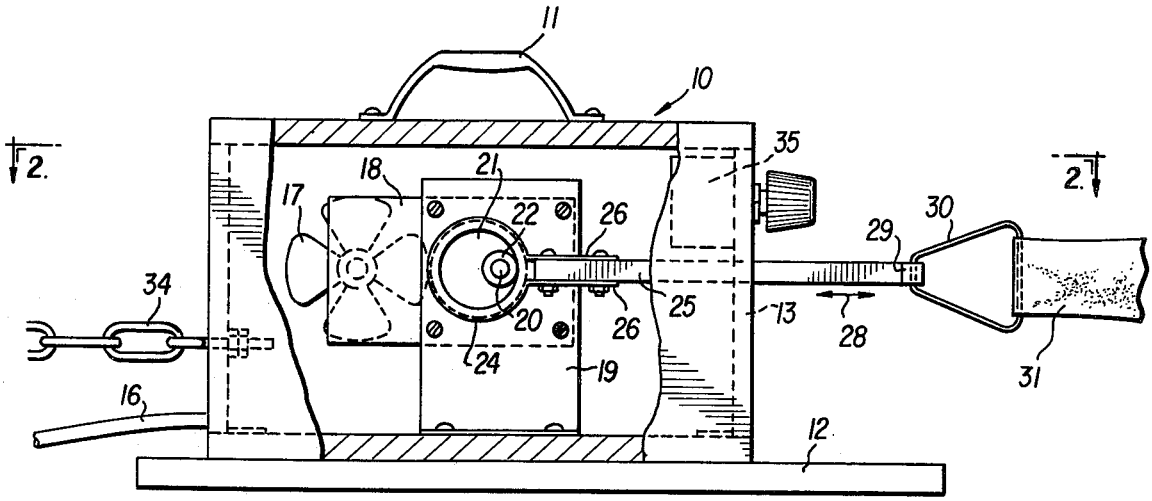
FIG. 1 is a side elevation view of the back and spine exercising machine of the present invention, with the housing partially cut away.
Figure 2:
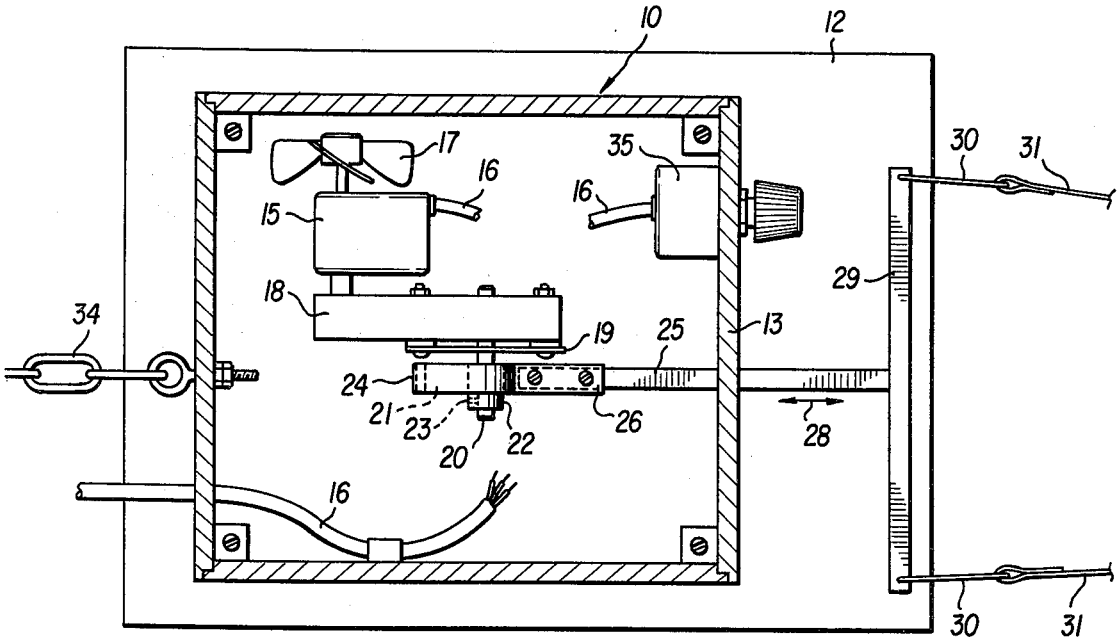
FIG. 2 is a cross sectional view taken along the line 2—2 of FIG. 1.

Referring to the drawings, the apparatus of the invention is shown as comprising a portable housing 10 having a carrying handle 11 and being mounted on a pedestal 12. An electric motor 15 is mounted in the housing, and is wired for home outlet energization as indicated by the wiring partially shown at 16. The motor 15 drives a cooling fan 17 and a speed reduction gear box 18 mounted on the floor of the housing by bracket 19. The output shaft 20 of the gear box 18 has an eccentric drive cam 21 affixed for rotation therewith by boss 22 and set screw 23. A bearing collar 24 is circumferentially mounted on the eccentric drive cam 21. Collar 24 is affixed to drive rod 25 by projecting ears 26, and the drive rod 25 passes through an opening 27 in the front wall 13 of the housing. The opening 27 is made to conform substantially to the cross sectional shape and size of the drive rod 25, whereby the drive rod is confined essentially to axial reciprocation along the line 28. This restraint on rod 25 obviously restrains collar 24 against rotation as cam 21 rotates therewithin.

Thus, when motor 15 is energized, it drives the speed reduction gears in box 18, whose output shaft rotationally drives the eccentric cam 21. Rotation of cam 21 in turn causes reciprocation of bearing collar 24 and rod 25 along the line 28. This drive structure is one well known form of crank and pitman for converting rotary motion of the shaft 20 to reciprocating motion of the pitman or rod 25. Because eccentric cam 21 effects a uniform 360° rotation about the shaft 20, the amplitude of the reciprocating motion of shaft 25 is inherently equal in both directions, or is symmetrical, and if that amplitude were plotted against time, it would produce a 360° sinusoidal waveform.

Figure 3:
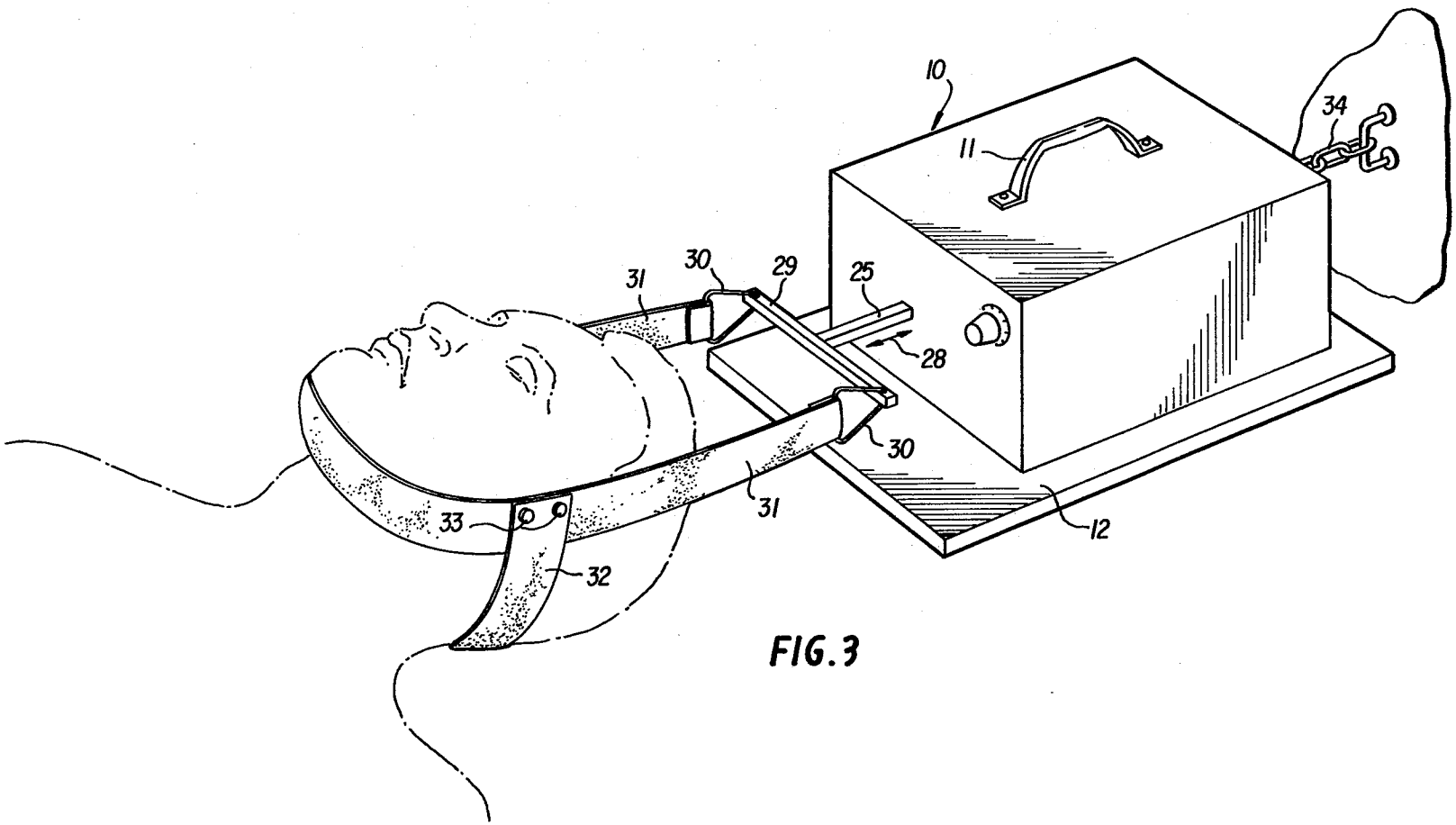
FIG. 3 is an illustration of the machine of FIGS. 1 and 2 as applied to a user.

The end of drive rod 25 projecting from the housing 10 is provided with a T bar 29. A pair of triangular hooks or rings 30 are affixed to the T bar 29, one at each end of the bar, to which are attached the ends of a flexible strap 31. As shown in FIG. 3, the strap 31 is a chin strap adapted to go around the head of a user, and engage under his chin. In addition, a retaining strap 32 spans across the two sides of the chin strap 31, adapted to be releasably secured by snaps 33, and to engage under the back of the neck and lower portion of the head of a user. The combination of chin strap 31 and retaining strap 32 provides a harness whereby a slight pull may be exerted on the neck and spine of the user.

Use of the machine is accomplished in the following manner. The machine is placed on the floor, and by means of the links 34 is anchored to a suitable piece of furniture, or to a wall. The user then lies on his back on the floor, preferably on a carpet, in line with drive rod 25, head toward the machine, and engages the harness 31, 32 about his chin and head, as shown in FIG. 3. The machine is then started, such as by activating a spring wound timer switch 35. The slow reciprocating motion of rod 25 is imparted to the neck and spine of the user by cyclically applying tension and relaxation of the tension to the harness 31, 32. The result is the application of a gentle exercising axial tension and relaxation to the back and spine of the user, as distinguished from the usual traction forces often applied to spines, or the vigorous vibratory actions often applied to various parts of the body.

Having thus described one specific embodiment of the invention, it will be apparent to those skilled in the art that various modifications can be made therein. Such modifications as are embraced by the spirit and scope of the appended claims are contemplated as being within the purview of the present invention.

What is claimed is:

1. A method of exercising the back and spine of a person, comprising the application to the spine of a gentle, slow cyclical action of alternate periods of tension and relaxation of the tension, by applying a harness to the head and chin of the user, and applying symmetrical and cyclic reciprocating motion of small amplitude having a 360° substantially sinusoidal waveform when plotted against time, and of slow period to said harness substantially along a line parallel to the axis of the spine.

2. A method as set forth in claim 1, wherein said amplitude is less than about one inch and said period is approximately six cycles per minute.

3. A method as set forth in claim 2, wherein said amplitude is about $\frac{7}{8}$ of an inch.

4. An apparatus for exercising the back and spine of a person, comprising drive means for generating a substantially linear, symmetrical and reciprocating cyclic motion of small amplitude having a 360° substantially sinusoidal waveform when plotted against time, and of slow period, said drive means comprising a rotary shaft, a crank, and a pitman coupled to said crank, a harness means adapted to engage about the chin and head of the person, and means coupling said pitman to said harness means to apply a gentle, slow, symmetrical and cyclical action of alternating periods of tension and relaxation of the tension to the spine of the person.

5. An apparatus as set forth in claim 4, wherein said amplitude is less than about one inch and said period is approximately six cycles per minute.

6. An apparatus as set forth in claim 5, wherein said amplitude is about $\frac{7}{8}$ of an inch.

* * * * *